United States Patent [19]

Suzuki et al.

[11] Patent Number: 4,627,703

[45] Date of Patent: Dec. 9, 1986

[54] APPARATUS FOR FORMING IMAGES FROM POSITIVE AND NEGATIVE ORIGINALS

[75] Inventors: Hiroaki Suzuki, Hachiohji; Shinji Murata, Tokyo; Masanari Shirai, Chigasaki; Kazuhiko Onuki, Tokyo, all of Japan

[73] Assignee: Canon Kabushiki Kaisha, Tokyo, Japan

[21] Appl. No.: 829,550

[22] Filed: Feb. 13, 1986

Related U.S. Application Data

[63] Continuation of Ser. No. 669,064, Nov. 7, 1984, abandoned.

[30] Foreign Application Priority Data

| | | | |
|---|---|---|---|
| Nov. 17, 1983 | [JP] | Japan | 58-216794 |
| Nov. 17, 1983 | [JP] | Japan | 58-216795 |
| Nov. 17, 1983 | [JP] | Japan | 58-216796 |

[51] Int. Cl.[4] ..... G03G 15/00

[52] U.S. Cl. ..... 355/3 R; 355/8; 355/11; 355/71

[58] Field of Search ..... 355/3 R, 8, 11, 71, 355/4, 3 DR, 15, 57, 14 R

[56] References Cited

U.S. PATENT DOCUMENTS

| | | | |
|---|---|---|---|
| 2,890,968 | 6/1959 | Giaimo, Jr. | 355/4 X |
| 3,600,083 | 8/1971 | Leedom | 355/3 R X |
| 3,671,120 | 6/1972 | Kuehnle | 355/8 |
| 4,239,374 | 12/1980 | Tatsumi et al. | 355/14 E |
| 4,305,650 | 12/1981 | Knox | 355/71 X |
| 4,306,804 | 12/1981 | Sakamoto et al. | 355/71 X |
| 4,376,577 | 3/1983 | Okamoto | 355/3 DR |
| 4,500,195 | 2/1985 | Hosono | 355/3 R |
| 4,511,237 | 4/1985 | Kawata et al. | 355/8 X |
| 4,519,694 | 5/1985 | Kashiwagi et al. | 355/14 E X |

*Primary Examiner*—A. C. Prescott

*Attorney, Agent, or Firm*—Fitzpatrick, Cella, Harper & Scinto

[57] ABSTRACT

An image forming apparatus which is capable of forming a positive image either from a negative original or a positive original. The apparatus is provided with a device for preventing the non-image area of the photosensitive member from being developed by a developer, so as to avoid a wastefull consumption of the developer. The operation of the preventing means is controlled in dependence on whether the original is positive or negative, so that the prevention of the non-image area development is effectively performed independently of whether the original is negative or positive.

21 Claims, 10 Drawing Figures

APPARATUS FOR FORMING IMAGES FROM POSITIVE AND NEGATIVE ORIGINALS

This application is a continuation of application Ser. No. 669,064, filed Nov. 7, 1984, now abandoned.

BACKGROUND OF THE INVENTION

The present invention relates to an image forming apparatus, such as a reader-printer for projecting an enlarged image of a microfilm to allow the observation thereof by the operator and for producing a hard copy of the microfilm through an electrophotographic process, a printer wherein a photosensitive member is exposed to a light image provided by a computer or the like, by way of laser beam scanning, LED elements, to provide a hard copy of the light image, and an ordinary electrophotographic machine.

The original image of a microfilm is either positive or negative. However, a hard copy thereof is desired to be positive, irrespective of whether or not the original is positive, so that the hard copy is easily read. Therefore, a reader-printer is preferably capable of producing a positive image copy from a positive original and from a negative original. Heretofore, there has been no such apparatus that the mode can be easily switched between a mode wherein a positive copy is obtained from a positive original (hereinafter called "P-P mode") and a mode wherein a positive copy is obtained from a negative original (hereinafter called "N-P mode").

In machines, such as a reader-printer and an electrophotographic copying machine, which use an electrophotography, the area of a photosensitive member which is not exposed to the light image, retains the electric charge. Such an area of the photosensitive member attracts the developing toner during the developing operation in the P-P mode, that is, the area is developed. The development of the unnecessary area wastes the toner. It is usual, in order to prevent this, that a uniform light is projected onto the surface of the photosensitive member when the light image is not projected thereonto. That is a so-called blank exposure.

In the N-P mode development (reversal development), on the other hand, the developing toner is deposited on such area of the photosensitive member as has been exposed to light, but the area not exposed to the light, that is, the area still retaining the electric charge, does not attract the developing toner. Therefore, if the above described blank exposure is effected in the N-P mode development, the developing toner is deposited onto the area exposed to the light by the blank exposure. Namely, the toner is deposited on the non-image area, which has not been exposed to the image light. The deposited toner is not transferred to a transfer material, but simply removed from the photosensitive member and consumed wastefully.

SUMMARY OF THE INVENTION

Accordingly, it is a principal object of the present invention to provide an image forming apparatus and a cartridge usable therewith, which is selectively operable in the P-P mode or N-P mode, and wherein a non-image area of a photosensitive member is not developed.

It is another object of the present invention to provide a reader-printer and a cartridge usable therewith, which is selectively operable in the P-P mode or N-P mode with a simple structure.

It is a further object of the present invention to provide an image forming apparatus and a cartridge usable therewith, which can be switched between the P-P mode and N-P mode without the non-image area of the photosensitive member developed.

It is a further object of the present invention to provide an image forming apparatus and a cartridge usable therewith, wherein the development in the non-image area is automatically prevented.

These and other objects, features and advantages of the present invention will become more apparent upon a consideration of the following description of the preferred embodiments of the present invention taken in conjunction with the accompanying drawings.

According to an embodiment of the present invention, there is provided a cartridge detachably mountable into an image forming apparatus, comprising: a photosensitive member; a casing for supporting the photosensitive member; and means, operable when mounted in the main assembly, for actuating means for preventing a non-image area of the photosensitive member from being exposed to light, upon formation of a positive image from a negative original.

According to an embodiment of the present invention, there is provided an image forming apparatus for forming a positive image from a negative and positive originals, comprising: a main assembly; a cartridge detachably mountable into the main assembly and containing a photosensitive member; means for preventing a non-image area of the photosensitive member from being exposed to light; means for actuating the preventing means in association with an imagewise exposure of the photosensitive member; and means for disabling operation of the preventing means, depending on the kind of the cartridge mounted in the main assembly.

DESCRIPTION OF THE PREFERRED EMBODIMENTS

The preferred embodiments of the present invention will be described in detail in conjunction with the accompanying drawings.

Figure 1:
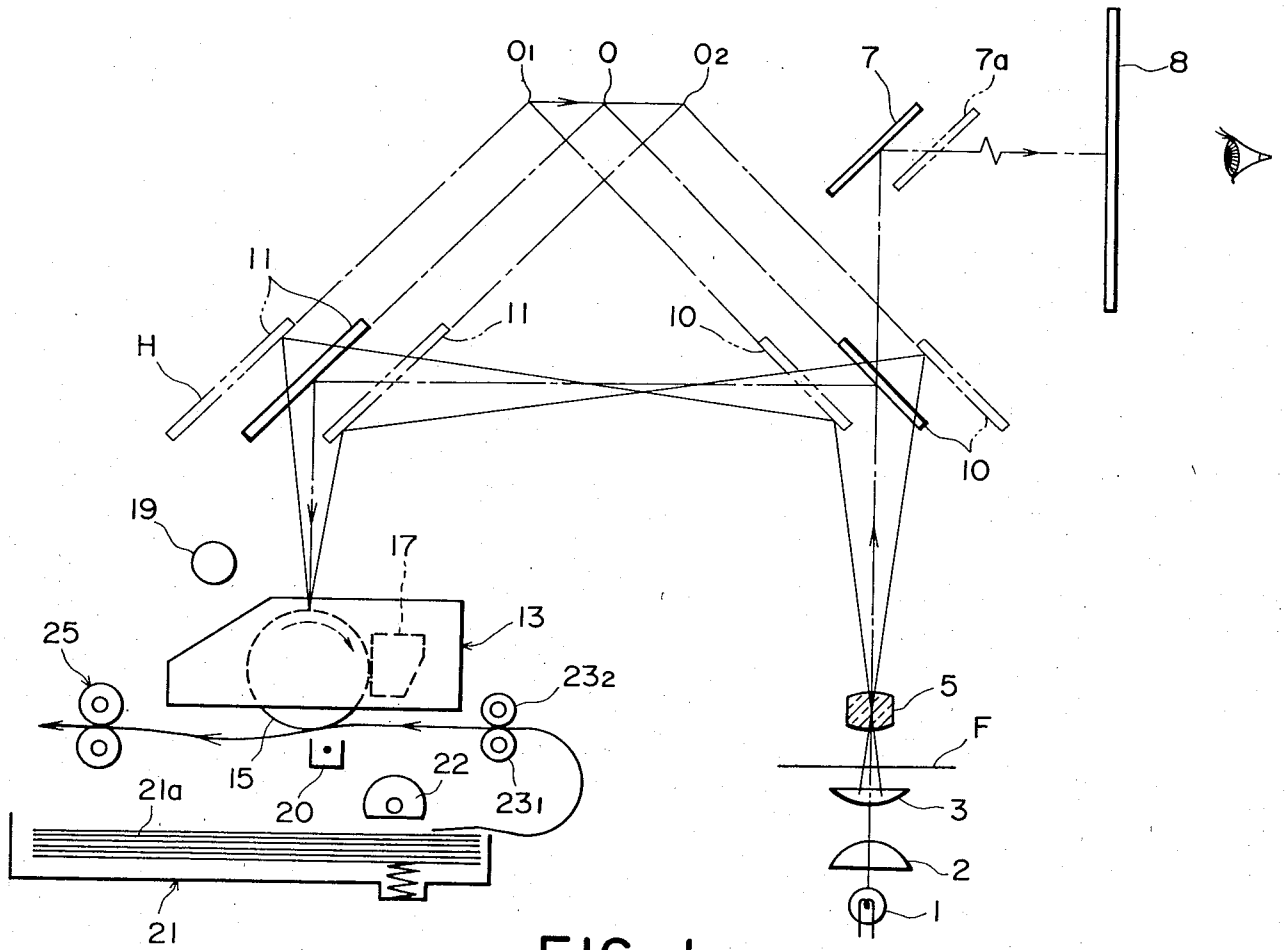
FIG. 1 is a schematic illustration of a reader-printer to which the present invention is applicable.

Referring now to FIG. 1, there is schematically shown a reader-printer to which the present invention is applicable.

The reader-printer is shown as having an image projection station comprising a light source 1 for illuminating a film F, such as a halogen lamp, a condenser lens 2, a field lens 3 and a projection lens 5. It has a reading station comprising a screen 8, where an enlarged image of the film F is observed. A mirror 7*a*, which is schematically shown in FIG. 1, is effective to convert a mirror image to an ordinary image when seen on the screen 8. The reader-printer further includes a copying station to which the light image produced by the projection station is introduced by way of a scanning mirrors 10 and 11. The copying station includes various process means for an electrophotographic image formation. A process cartridge 13 is loaded into the copying station. The process cartridge 13 is provided with at least a part of the process means. The copying station includes a pre-exposure discharging lamp 19, a transfer charger 20, a cassette 21 for accommodating transfer materials 21*a*, a registration roller 22 transfer material feeding rollers $23_1$ and $23_2$ and an image fixing device 25.

Figure 2:
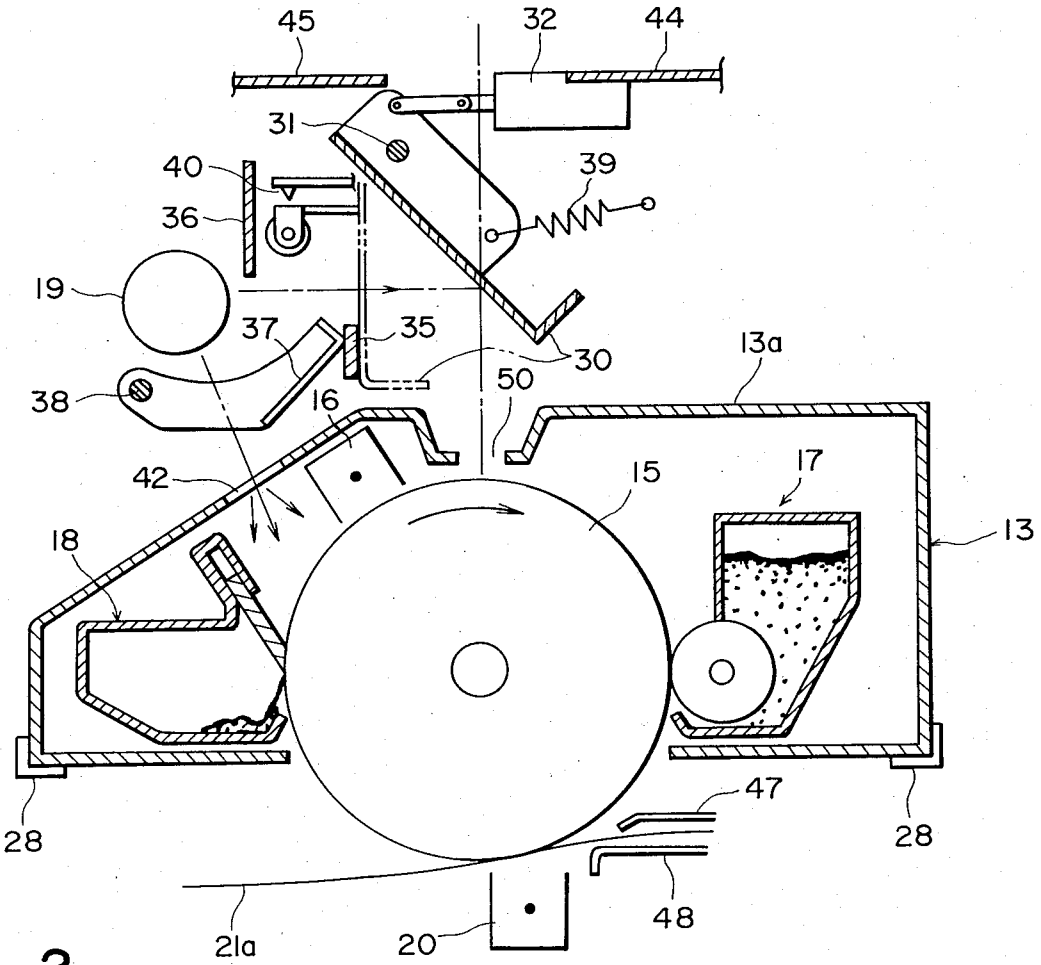
FIG. 2 is an enlarged cross-section of a part of a reader-printer according to an embodiment of the present invention.
Figure 3:
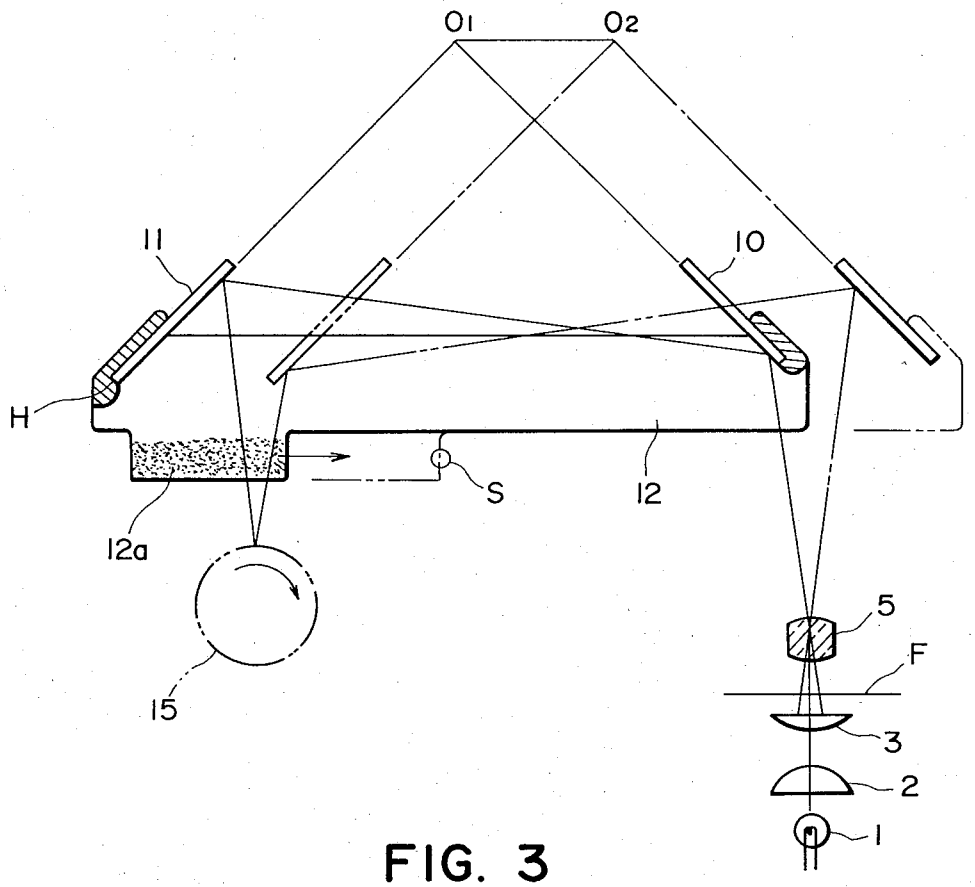
FIG. 3 is a schematic illustration for explaining the control of the blank exposure operation.

FIG. 2 is a cross-sectional view of a major part of the reader-printer which is in the P-P mode with a positive original film F.

The process cartridge 13 can be inserted into or retracted from the reader-printer in the direction perpendicular to the sheet of the drawing of FIG. 2 along the guide rails 28 fixed on a frame of the reader-printer. The process cartridge 13 contains therein a photosensitive member 15, a corona charger 16, a developing device 17 and a cleaning device 18, which are all integral with each other, or which are detachable from the process cartridge 13. A casing 13*a* is provided to support those elements. The cartridge 13 shown in FIG. 2 is for the P-P mode development, and therefore, the developing toner of the developing device 17 has the polarity opposite to the polarity to which the photosensitive member 15 is electrically charged by the corona charger 16. A blank exposure blocking plate 30 is rotatably mounted to the frame of the reader-printer by a pin 31. The blocking plate 30 is effective to block the optical path for the image exposure, that is, it takes the position shown by the solid lines in FIG. 2, when the scanning mirrors 10 and 11 move in a non-scanning direction or when the reader-printer is set to a reading state, in brief, when the photosensitive member 15 is not exposed to the light image. The blocking plate 30 has a lower surface which is a reflecting surface. The blocking plate 30 is rotatable about the pin 31 by the energization of a solenoid 32 to take a position shown by the chain lines in FIG. 2, wherein the blocking plate 31 is engaged to a stopper 35. The blocking plate 30 takes this position during the photosensitive member 15 being exposed to the light image. When the blocking plate 30 takes place this position, the image exposure optical path is opened, while the blank exposure optical path is closed.

An explanation will be made with respect to the operation of the blocking plate 30. The energization or the de-energization of the solenoid 32 for driving the blocking plate 30 are controlled on the basis of the position of the scanning mirror 10 or 11 which travels during the scanning operation through one-half of the length of a copy sheet 21*a* on which the copy image is to be formed. In this embodiment, the mirrors 10 and 11 are supported on a mirror support 12, which is provided with a detecting portion 12*a* or a projection in this embodiment. The projection is detected by a position sensor S fixed to the frame of the reader-printer. The sensor S may be of a Hall IC element type or a photocoupler element type. During the time when the sensor S detects the projection 12*a*, the solenoid 32 is energized, so that the image exposure optical path is opened during the image exposure period.

Figure 4:
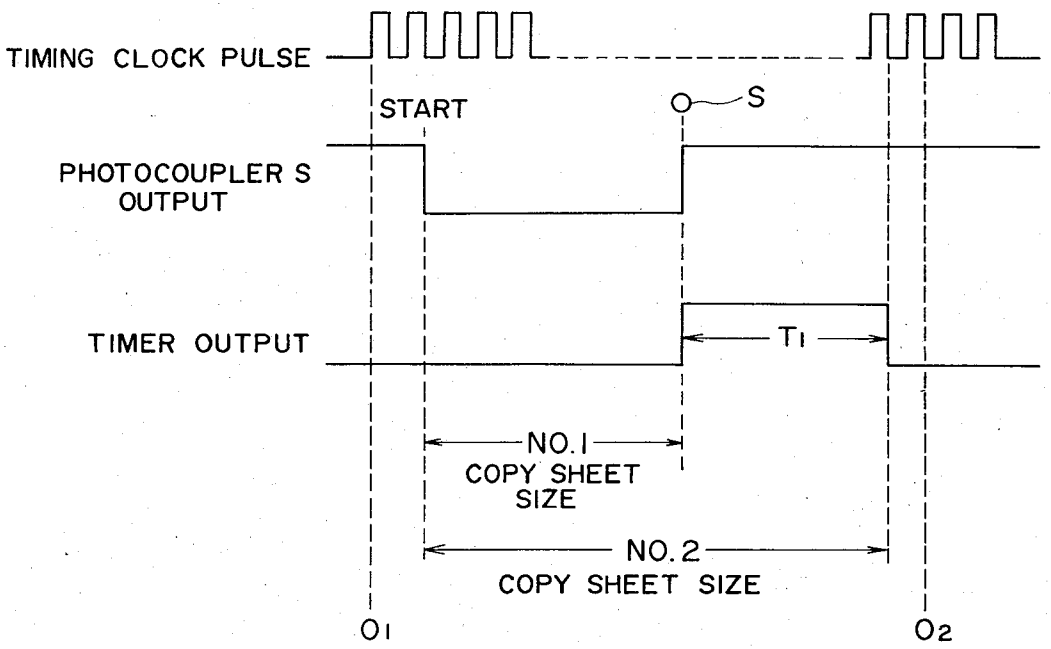
FIG. 4 is a timing chart for the blank exposure control when different sizes of the originals are used.

In order to meet various sizes of the copy sheets 21*a*, a timer (not shown) is provided, which is responsive to a copy sheet size selecting switch to extend the solenoid 32 energization time period, corresponding to the size of the copy sheet, as shown in FIG. 4.

By using a sensor or other electrical elements in combination, as described above, the reader-printer can cover any sizes of the copy sheets.

Referring back to FIG. 2, there is provided a shutter 37 which is pivotably supported on the frame of the reader-printer by a pin 38. The shutter 37 is so constructed as to open the blank exposure optical path during the P-P mode, as shown in FIG. 2. The shutter 37, in this state, is engaged to the stopper 35. A switch 40 is provided such that it can be actuated by the shutter 37 along its moving passage. The switch 40 is effective to set the process conditions of the reader-printer to meet the selected mode. The casing 13*a* of the process cartridge 13 has an opening for introducing to the photosensitive member 15 the light for erasing the light hysteresis thereof. The opening of the casing 13 is covered by a colored filter 42 of a light scattering type, and therefore, the light from the lamp 19 is scattered and transmitted therethrough. The spectrum transmission factor of the filter 42 is harmonized with the sensitivity characteristics, to the wavelength, of the photosensitive member, so that the noxious components are removed. The shutter 37 is sufficiently opened in the neighborhood of the filter 42 not to obstract the light of the lamp 19 from entering through the filter 42, independently of the position of the shutter 37. The reader-printer further comprises light blocking plates 44 and 45 and copy sheet guiding plates 47 and 48 for guiding the copy sheet or a transfer material 21*a* in this embodiment.

Figure 5:
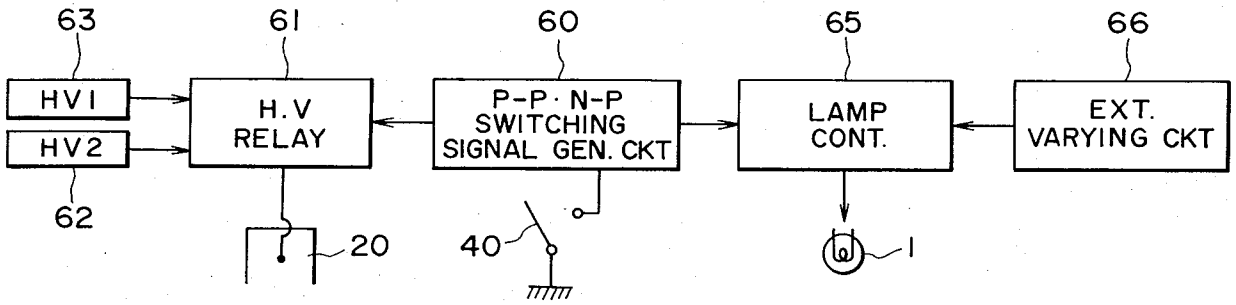
FIG. 5 is a block diagram for setting the process conditions.

FIG. 5 is a block diagram for setting the process conditions in response to the switch 40 operated upon selection of the mode. A circuit 60 is responsive to the switch 40 and generates a P-P mode signal or N-P mode signal so as to set the polarity of the voltage applied to the transfer discharger and the quantity of light of the illumination lamp 1 in accordance with the selected mode. The transfer corona charger 20 is supplied with a high voltage selectively from the high voltage source 62 which provides the voltage of the polarity suitable for the P-P mode development toner and from a high voltage source 63 of the polarity suitable for the transfer of the toner used in the N-P mode development. The polarities of the two high voltage sources 62 and 63 are opposite. A high voltage relay 61 is responsive to the circuit 60 and allows one of the high voltage sources 62 and 63 to be connected to the transfer charger 20. A lamp control circuit 65 for controlling the quantity of light of the lamp 1 is also responsive to the circuit 60 to control the quantity of light produced by the light source 1 in accordance with the mode selected. An externally operable varying circuit is provided for transmitting to the circuit 65 the signal for changing the quantity of light of the light source in accordance with the image density and the contrast of the film.

Figure 6:
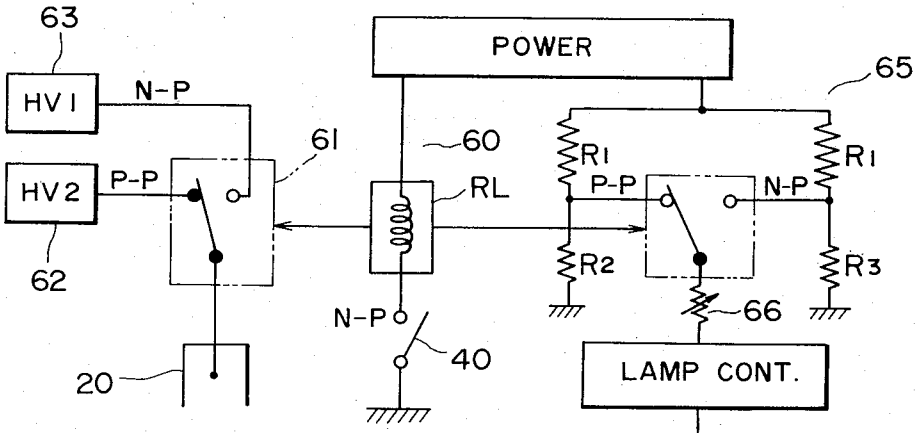
FIG. 6 is an electric circuit embodying the block diagram of FIG. 5.

FIG. 6 shows an electric circuit which embodies the block diagram of FIG. 5. When the process cartridge of N-P mode is loaded into the reader-printer, the switch 40 is actuated to connect the ground side of the relay RL to the ground to energize the relay RL. Then, the relay RL directly or indirectly operates the high voltage relay 61 and simultaneously selects for the illumination lamp 1 a voltage predetermined for the N-P mode in the lamp control circuit 65. The difference between the voltages for the two modes is provided by the difference in the resistance between the resistors R2 and R3. Thus, the polarity of the high voltage applied to the transfer corona charger and the amount of the light produced by the illumination lamp 1 are determined in response to the mode selected, that is, the N-P mode or the P-P mode. More particularly, the transfer charger 20 is supplied with the high voltage with the polarity which is opposite to the polarity of the toner deposited on the photosensitive member 15, the polarity of the toner being determined in accordance with the mode selected. The amount of the light produced by the illumination lamp 1 is larger by 100% in the N-P mode than in the P-P mode. Those are automatically effected. As for the changing of the quantity of light, the current and/or a phase of an AC power may be controlled in place of the above described voltage control.

Operations of the reader-printer according to this embodiment of the present invention will now be described. When an image of the film F is projected on the screen 8, the scanning mirrors 10 and 11 are placed at their home positions H, at which the mirror 10 is away from the optical path extending from the projection lens 5 to the screen 8. When, on the other hand, the film F is to be copied. The mirror 10, together with the mirror 11, is driven by an unshown driving mechanism into the optical path and projects an image of the film F, while scanning the same, onto the surface of the photosensitive member 15 which is rotating in the direction shown by the arrow. The speed of the scanning movement of the scanning mirrors 10 and 11 is one-half of the peripheral speed of the photosensitive member 15. The scanning mirrors 10 and 11 are positioned perpendicular to each other, so that the extensions of the mirrors 10 and 11 are orthogonally intersected at a point O, as shown in FIG. 1. The mirrors 10 and 11 moving from their home positions H, in effect, scans the original at a constant speed from the position $O_1$ to the position $O_2$. The image light introduced by the scanning mirrors 10 and 11 enters through the opening provided in the light blocking plates 44 and 45 and through the opening 50 provided in the casing 13*a* of the process cartridge 13 on to the photosensitive member 15.

Figure 7:
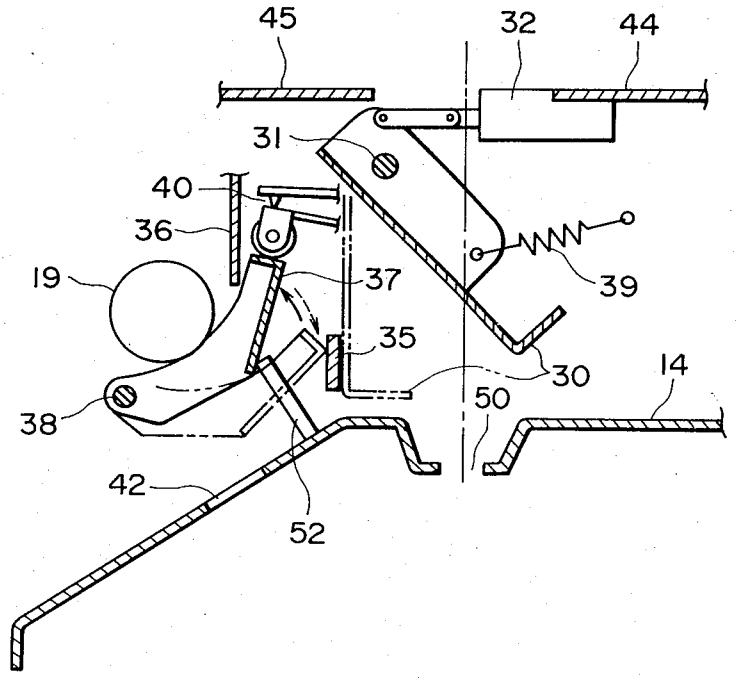
FIG. 7 is a cross-sectional view of a part of the reader-printer when an N-P mode cartridge is used.

When the original is a positive one, the image forming process is performed at the copying station in the P-P mode, that is, an usual electrophotographic process. The light produced by the pre-exposure lamp 19 reaches through the filter 42 the photosensitive member 15 to remove the hysteresis of the photosensitive member 15, and simultaneously is incident on the reflecting surface of the light blocking plate 30 which takes the position shown by the solid lines, since the shutter 37 is opened (non-image area). The light reflected by the reflecting surface is then indicent on the photosensitive member 15 to effect the blank exposure, that is, to expose the non-image area of the photosensitive member 15. Since the switch 40 opens, the circuit 60 discriminates that it is in the P-P mode. Thus, the transfer corona charger 20 is supplied with a voltage of the polarity which meets the P-P mode. Also, the quantity of light generated by the lamp 1 is harmonized with the P-P mode. When, on the other hand, a negative film is used, that is, when the reader-printer is to be operated in the N-P mode, the cartridge 13 having the P-P mode developing device 17 is interchanged with a cartridge 14 having the N-P mode developing device (not shown), which contains the developer toner which is and can be electrically charged to a polarity opposite to the polarity to which the developer toner contained in the P-P mode developing device is charged or is chargeable. As shown in FIG. 7, the cartridge 14 is provided, at its outside surface corresponding to the bottom part of the shutter 37, with a cam 52 which is inclined in the direction of the insertion of the cartridge.

While the cartridge 14 is being inserted into the reader-printer along the rails 28, the cam 52 lifts the shutter 37 until it is partly overlapped with the light blocking plate 36, so that the shutter 37 blocks the optical path from the lamp 19 to the reflecting surface of the light blocking plate 30. As shown in FIG. 7, the shutter 37 is moved to the closing position by the rotation thereof in the direction shown by the solid arrow, when the cartridge 14 is inserted. The shutter 37 opens by the rotation in the direction shown by the chain lines, when the cartridge 14 is retracted from the reader-printer. In addition, the shutter 37 pushes the upper switch 40 to automatically switch the control means to the N-P mode.

With the various elements set in the manner described above, a copying operation is effected in the N-P mode for a negative original. Since the shutter 47 is at its closing position, the light from the pre-exposure lamp 19 does not reach the photosensitive member 15, even when the light blocking plate 30 takes the position indicated by the solid lines. That is, the blank exposure is disabled. Because of the switch 40 being actuated, that is, the mode is set to the N-P mode, the polarity of the voltage applied to the transfer charger 20 is switched, and the light quantity of the illumination lamp 1 is made suitable for the N-P mode. Therefore, the non-image area on the photosensitive member 15 surface is not developed, so that the developing toner is not wastefully consumed.

In accordance with the embodiment described above, an apparatus was constructed. As for the P-P mode cartridge, an OPC (organic photoconductor) was used as a photosensitive layer of the photosensitive member 15. The charger 16 was supplied with a voltage of −5.2 KV and 500 μA to uniformly charge the photosensitive member. The charged photosensitive member was exposed to a positive light image of the light quantity of 12 lux.sec measured on the surface of the photosensitive member. The electrostatic latent image formed thereby was developed by insulating and magnetic developer particles which were charged to the positive polarity. The toner image thus formed on the photosensitive member 15 was transferred to the copy sheet 21*a* by the transfer corona discharger 20 supplied with a negative polarity voltage of 5 KV and 300 μA. The blank exposure was effected by the lamp 19 giving the light of 24 lux.sec measured on the surface of the photosensitive member surface. The light for the blank exposure was introduoced to the photosensitive member by the reflecting surface of the light blocking plate 30 taking the position shown by the solid lines in FIG. 2. It was confirmed that the blank exposure was sufficient under the above conditions.

As for the N-P mode cartridge, the same photosensitive material, namely, OPC photosensitive layer was used. The corona charger 16 was supplied with a voltage of −5.2 KV and 500 μA to uniformly charge the photosensitive member. The image exposure of the photosensitive member was effected by the light having the light quantity of 1.8–2 times in the light quantity of the halogen lamp. The electrostatic latent image formed by the above steps was developed by the toner particles charged to the opposite polarity, that is, to the negative polarity. The toner image formed on the photosensitive member was transferred onto the copy sheet 21*a* by the transfer corona discharger 20 supplied with a negative polarity voltage of 5 KV and 160 μA. The effect of the blank exposure in this mode is provided by the shutter 37 blocking the light from the lamp 19. Since the toner particles are not deposited on the dark area, the toner particles are not wasted by being deposited on the non-image area.

As described in the foregoing, according to this embodiment of the present invention, the effect of blank exposure is insured, and proper process conditions are set, when the process cartridges having different mode (P-P mode or N-P mode) are loaded into the reader-printer, as desired. The process conditions may be as described above, but may include a developing bias or combinations therebetween.

The switching between the P-P mode and the N-P mode is carried out by a combination of mechanical links and electrical switches, so that the structures are very simple.

The switch 40 may be modified so that it is operated directly by the cam or the casing of the cartridge or that a photocoupler is used. The switch may be rendered "on" when in the P-P mode, and rendered "off" when in the N-P mode.

In this embodiment, two types of the cartridges, that is the P-P mode cartridge and the N-P mode cartridge, are used. The cartridges having different color particles may be provided for each of the above two types of the cartridges. Then, the color of the copy can be selected together with the selection of the mode, so that the applicability is increased.

Figure 8:
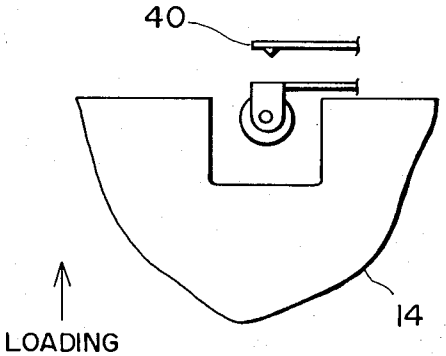
FIG. 8 illustrates a modified switch driving mechanism.

In the foregoing embodiments, the activation and deactivation of the switch 40 are effected by some projection and the flat portion, but they may be effected by a flat portion and a recessed portion, as shown in FIG. 8.

Figure 9:
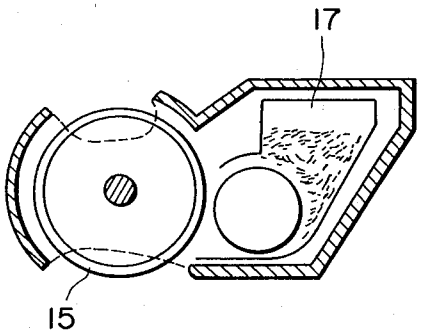
FIGS. 9 and 10 are cross-sectional views of the cartridges according to other embodiments of the present invention.
Figure 10:
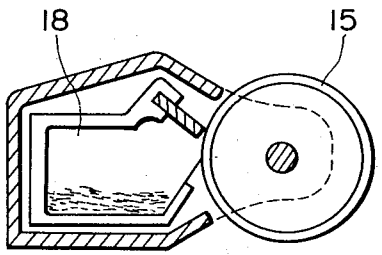

The structure of the cartridge is not limiting, but it may contain only the photosensitive member 15 and the developing device 17, as shown in FIG. 9, or it may contain only the photosensitive member 15 and the cleaning device 18, as shown in FIG. 10.

While the invention has been described with reference to the structures disclosed herein, it is not confined to the details set forth and this application is intended to cover such modifications or changes as may come within the purposes of the improvements or the scope of the following claims.

What is claimed is:

1. A cartridge detachably mountable into an image forming apparatus, comprising:

a photosensitive member;

a casing for supporting said photosensitive member; and means, operable when mounted in the main assembly, for actuating means for preventing a non-image area of said photosensitive member from being exposed to light, upon formation of a positive image from a negative original.

2. A cartridge according to claim 1, wherein said actuating means includes a projection formed on said casing.

3. A cartridge according to claim 1, wherein the actuation of said actuating means is effected by said actuating means not acting on said preventing means.

4. A cartridge according to claim 1, wherein process conditions for the photosensitive member are automatically set when said cartridge is mounted into said main assembly.

5. A cartridge according to claim 4, wherein said cartridge controls means provided in said main assembly to form an image of the original.

6. A cartridge according to claim 1, further comprising means for developing a latent image formed on said photosensitive member.

7. A cartridge according to claim 1, further comprising at cleaning means for removing residual toner from said photosensitive member.

8. A cartridge according to claim 1, further comprising a discharger for uniformly charging said photosensitive member, means for developing a latent image formed on said photosensitive member and cleaning means for removing residual toner from said photosensitive member.

9. An image forming apparatus for forming a positive image from a negative and positive originals, comprising:

a main assembly;

a cartridge detachably mountable into said main assembly and containing a photosensitive member;

means for preventing a non-image area of the photosensitive member from being exposed to light;

means for actuating said preventing means in association with an imagewise exposure of the photosensitive member; and means for disabling operation of said preventing means, depending on the kind of the cartridge mounted in said main assembly.

10. An apparatus according to claim 9, wherein said preventing means includes a combination of a movable reflecting mirror for reflecting light from a light source to the photosensitive member and a member for blocking a light.

11. An apparatus according to claim 10, wherein said disabling means includes light blocking means disposed optically between the light source and the reflecting mirror.

12. An apparatus according to claim 9, wherein said disabling means is operated in response to the mounting and demounting of a cartridge which is for negative originals.

13. An apparatus according to claim 9, wherein the cartridge, when mounted into said main assembly, actuates said disabling means and sets an image forming process condition corresponding to the cartridge.

14. An apparatus according to claim 13, wherein the image forming condition is a quantity of light for illuminating an original.

15. An apparatus according to claim 9, wherein said apparatus is a printer for reproducing a microfilm.

16. An assembly usable with a process cartridge for forming positive images from a negative and positive originals, comprising:

blank exposure means for exposing to light a non-image area of a photosensitive member contained in the process cartridge;

means for actuating said blank exposure means to expose the non-image area of the photosensitive member to light; and means, actuable by the process cartridge, for disabling said exposure means.

17. An image forming apparatus for forming a positive image either from negative or positive originals, comprising:

a main assembly;

a cartridge detachably mounted into said main assembly and containing a photosensitive member;

means for preventing a non-image area of the photosensitive member from being exposed to light;

means for actuating said preventing means in association with an imagewise exposure of the photosensitive member; and means for disabling the operation of said preventing means, in association with a switching operation in said main assembly.

18. An apparatus according to claim 17, wherein said switching is effected in association with the mounting of said cartridge.

19. An apparatus according to claim 18, wherein said detachably mounted cartridge can be of more than one type and said switching is effected depending on the type of said cartridge.

20. An apparatus according to claim 18, further comprising a lamp for producing light for illuminating an original and for exposing the photosensitive member to light.

21. An assembly according to claim 16, wherein said blank exposure means uses light from a lamp for illuminating an original.

* * * * *